US010211563B2

(12) United States Patent
Zhao

(10) Patent No.: US 10,211,563 B2
(45) Date of Patent: Feb. 19, 2019

(54) ELECTRICAL CONNECTOR HAVING CONDUCTIVE CONTACTS NOT BEING CORRODED

(71) Applicant: FOXCONN INTERCONNECT TECHNOLOGY LIMITED, Grand Cayman (KY)

(72) Inventor: Jun Zhao, HuaiAn (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/980,686

(22) Filed: May 15, 2018

(65) Prior Publication Data

US 2018/0337486 A1 Nov. 22, 2018

(30) Foreign Application Priority Data

May 19, 2017 (CN) ..... 2017 1 0358611

(51) Int. Cl.
*H01R 13/648* (2006.01)
*H01R 13/52* (2006.01)
*H01R 13/6585* (2011.01)
*H01R 13/405* (2006.01)

(52) U.S. Cl.
CPC ..... *H01R 13/52* (2013.01); *H01R 13/405* (2013.01); *H01R 13/6585* (2013.01)

(58) Field of Classification Search
CPC ..... H01R 13/6587; H01R 13/6594; H01R 13/6873; H01R 13/7073
USPC ..... 439/607.4, 607.35, 660
See application file for complete search history.

(56) References Cited

U.S. PATENT DOCUMENTS 6,917,405 B2 * 7/2005 Kim ..... G02F 1/133555 349/113
9,178,319 B2 * 11/2015 Little ..... H01R 13/6585
10,038,260 B2 * 7/2018 Ju ..... H01R 24/78

FOREIGN PATENT DOCUMENTS

CN 204289826 4/2015

* cited by examiner

*Primary Examiner* — Phuong Dinh
(74) *Attorney, Agent, or Firm* — Wei Te Chung; Ming Chieh Chang

(57) ABSTRACT

An electrical connector includes an insulative housing and a number of conductive contacts affixed to the insulative housing. The insulative housing includes a base portion and a tongue portion extending forwardly from the base portion. The tongue portion has a stepped portion abutting with the base portion, a horizontal portion located at a front end of the stepped portion, and a boundary line located between the stepped portion and the horizontal portion. The stepped portion is thicker than the horizontal portion. The horizontal portion has two opposite mating surfaces. Each conductive contact has a contacting portion exposed to the mating surface, a connecting portion affixed to the stepped portion and the base portion, and a soldering portion extending outwardly from the base portion. The contacting portion abutting with the boundary line is covered by insulative materials.

11 Claims, 9 Drawing Sheets

ELECTRICAL CONNECTOR HAVING CONDUCTIVE CONTACTS NOT BEING CORRODED

BACKGROUND OF THE DISCLOSURE

1. Field of the Disclosure

The present disclosure relates to an electrical connector, and more particularly to an electrical connector that protects the conductive contacts being corroded.

2. Description of Related Arts

China Patent No. CN204289826U discloses an electrical connector including an insulative housing, a number of conductive contacts affixed to the insulative housing, a shielding plate affixed to the insulative housing, and a main shell enclosing the insulative housing for forming a receiving room. The insulative housing includes a base portion received in the receiving room and a tongue portion. The tongue portion includes a stepped portion and a mating portion located at a front end of the stepped portion. The conductive contact is exposed to the stepped portion. The stepped portion is easy to collect liquid or other impurities such that the conductive contact exposed to the stepped portion is easily corroded, thereby affecting the function of the entire electrical connector, causing short circuiting, and the like.

An improved electrical connector is desired.

SUMMARY OF THE DISCLOSURE

Accordingly, an object of the present disclosure is to provide an electrical connector ensuring the conductive contacts not being corroded.

To achieve the above object, an electrical connector includes an insulative housing and a number of conductive contacts affixed to the insulative housing. The insulative housing includes a base portion and a tongue portion extending forwardly from the base portion. The tongue portion has a stepped portion abutting with the base portion, a horizontal portion located at a front end of the stepped portion and a boundary line located between the stepped portion and the horizontal portion. The stepped portion is thicker than the horizontal portion. The horizontal portion has two opposite mating surfaces. Each conductive contact has a contacting portion exposed to the mating surface, a connecting portion affixed to the stepped portion and the base portion, and a soldering portion extending outwardly from the base portion. The contacting portion abutting with the boundary line is covered by insulative materials making the conductive contacts not being corroded.

Other objects, advantages and novel features of the disclosure will become more apparent from the following detailed description when taken in conjunction with the accompanying drawings.

DETAILED DESCRIPTION OF THE PREFERRED EMBODIMENTS

Figure 7:
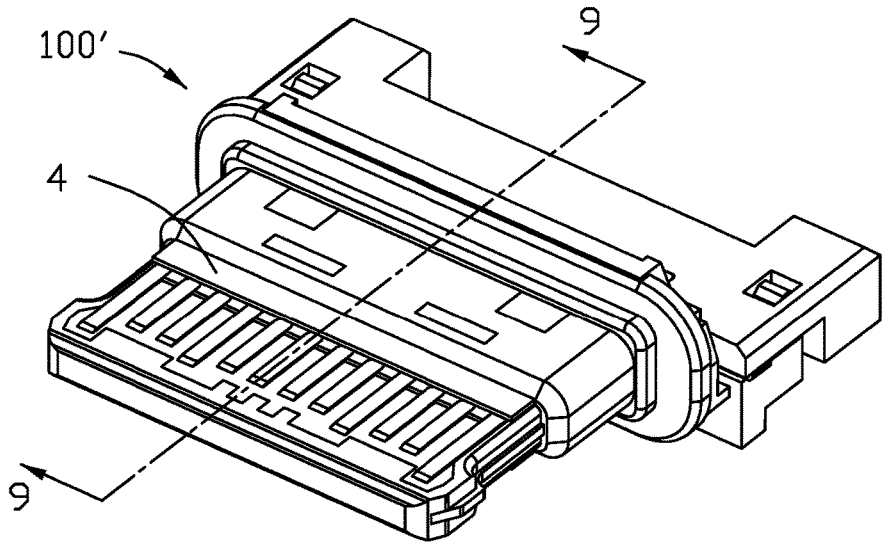
FIG. 7 is a perspective, assembled view of the electrical connector in a second embodiment.
Figure 8:
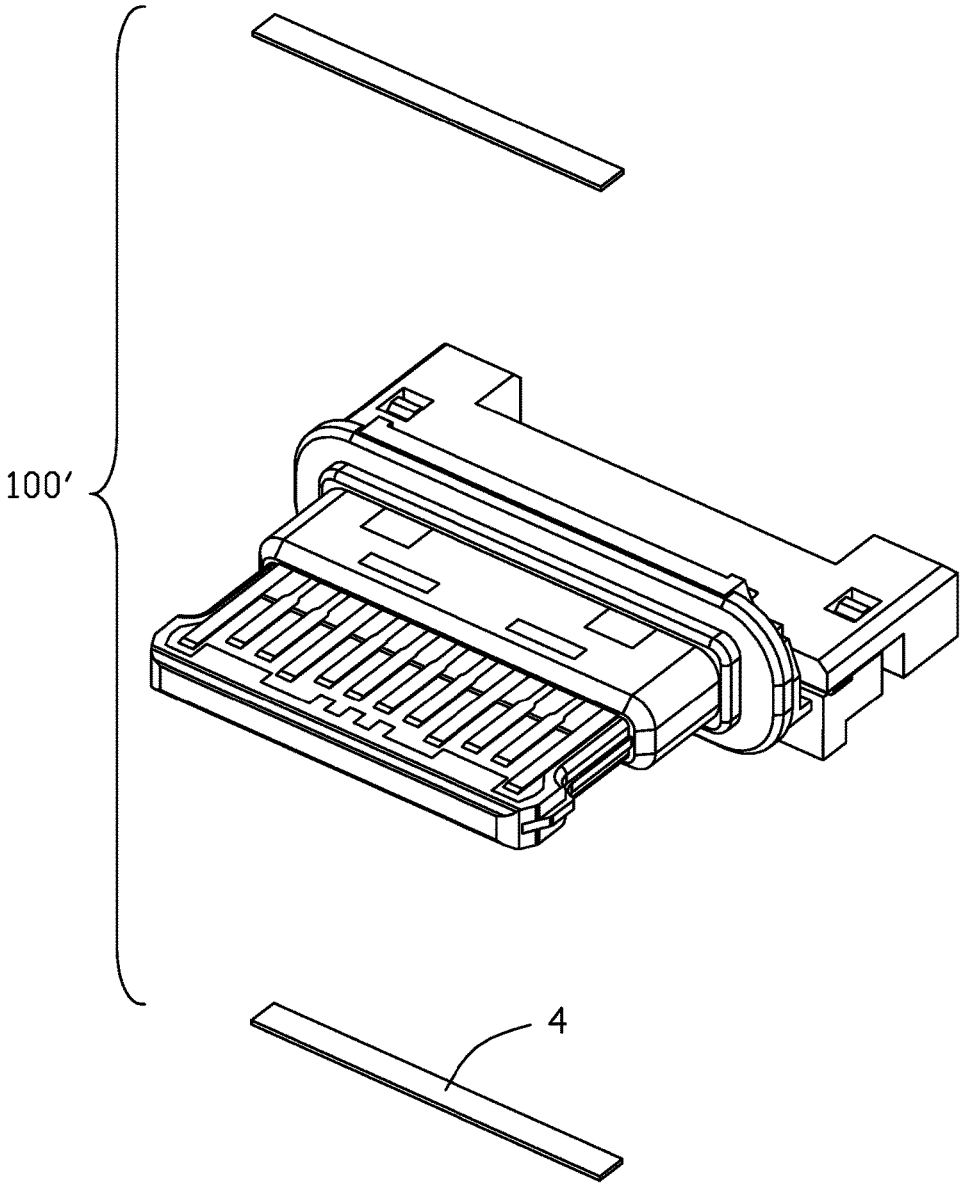
FIG. 8 is an exploded view of the electrical connector in the second embodiment.
Figure 9:
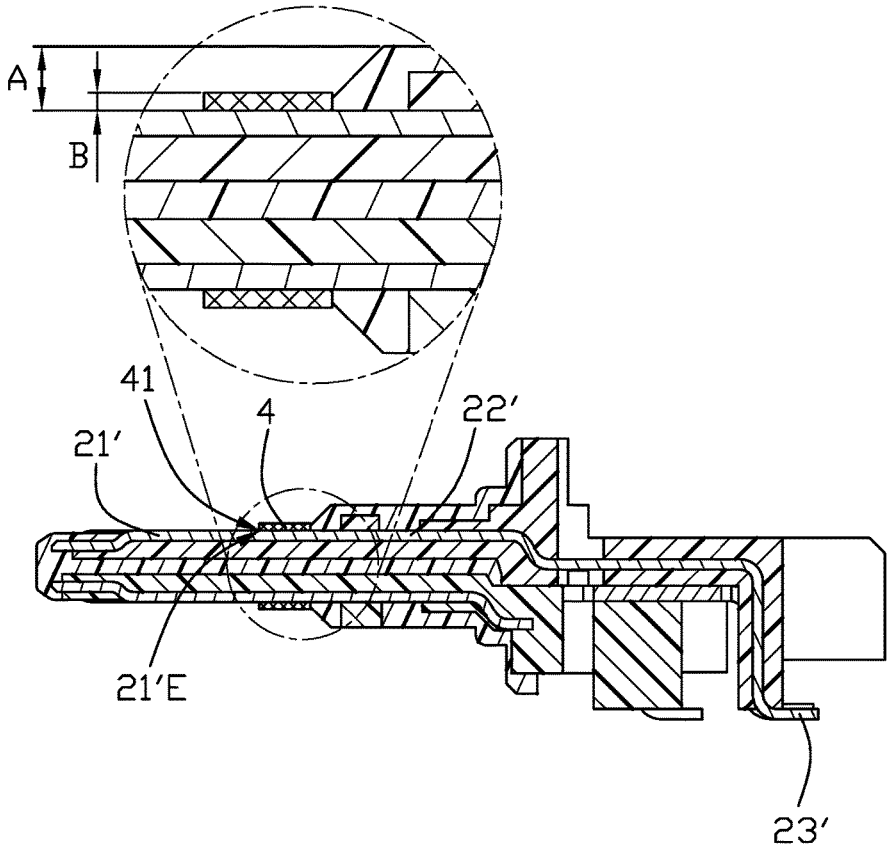
FIG. 9 is a cross-sectional view of the electrical connector taken along line 9-9 in FIG. 7 in the second embodiment.

Reference will now be made in detail to the embodiments of the present disclosure. A first embodiment is shown in FIGS. 1 to 6. A second embodiment is shown in FIGS. 7 to 9. A plug-in direction of the electrical connector 100 is a front-to-rear direction.

Referring to FIGS. 1 to 6, a USB Type C electrical connector 100 for mating with a USB Type C complementary plug connector (not shown) includes an insulative housing 1, a number of conductive contacts 2 affixed to the insulative housing 1, and a shielding plate 3 affixed to the insulative housing 1.

Figure 1:
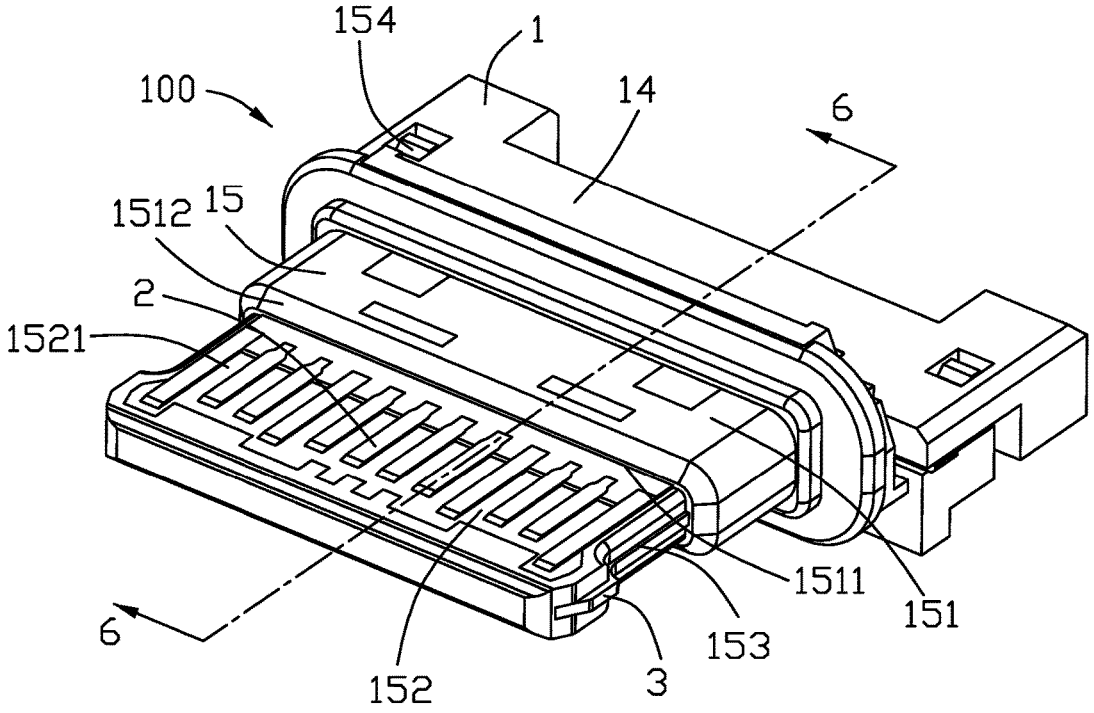
FIG. 1 is a perspective, assembled view of an electrical connector in a first embodiment.
Figure 2:
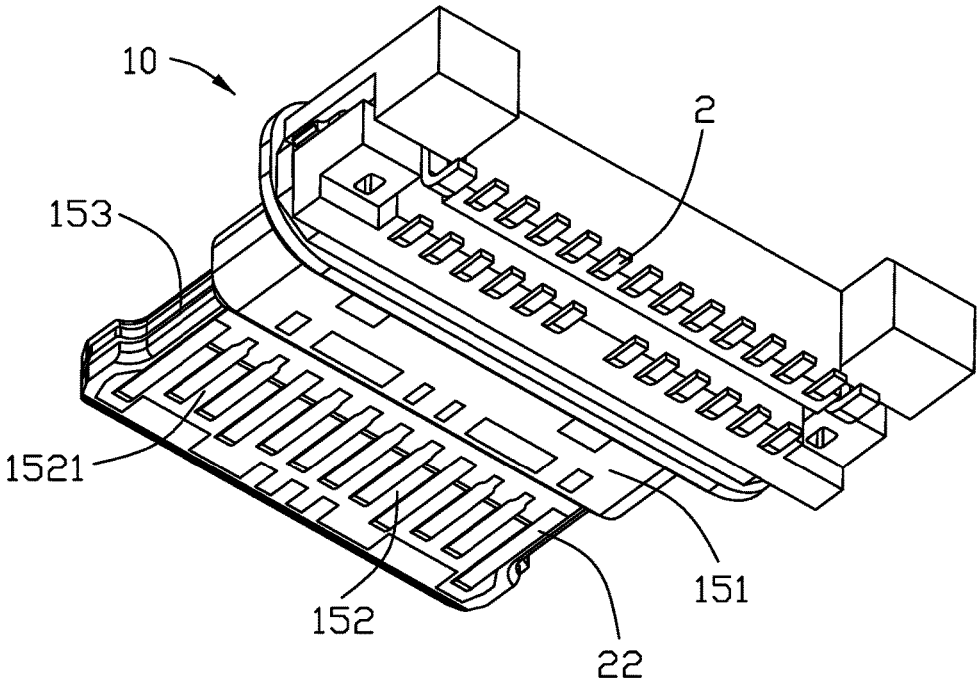
FIG. 2 is another assembled view of the electrical connector taken from FIG. 1 in the first embodiment.
Figure 3:
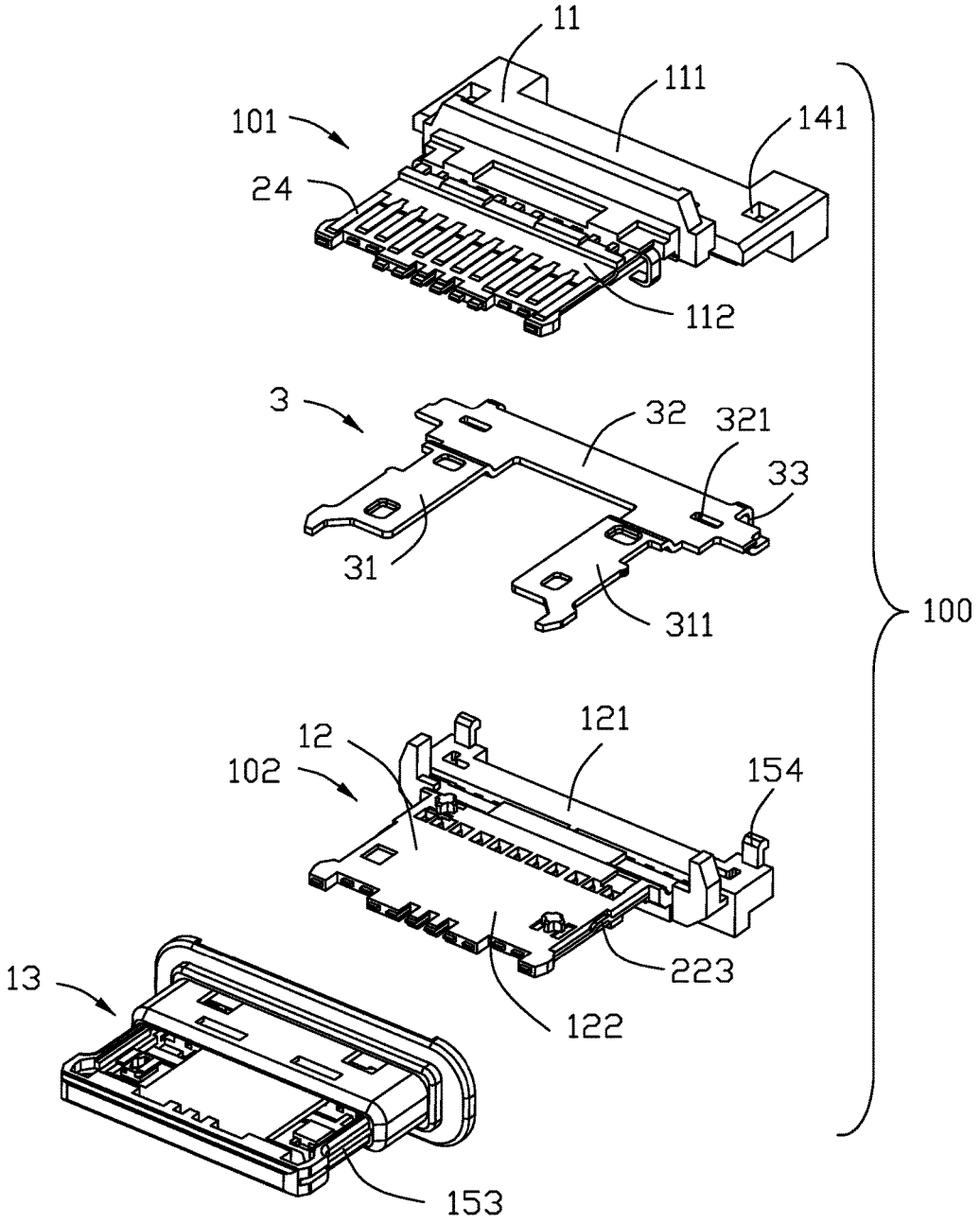
FIG. 3 is a partial exploded view of the electrical connector in the first embodiment.
Figure 4:
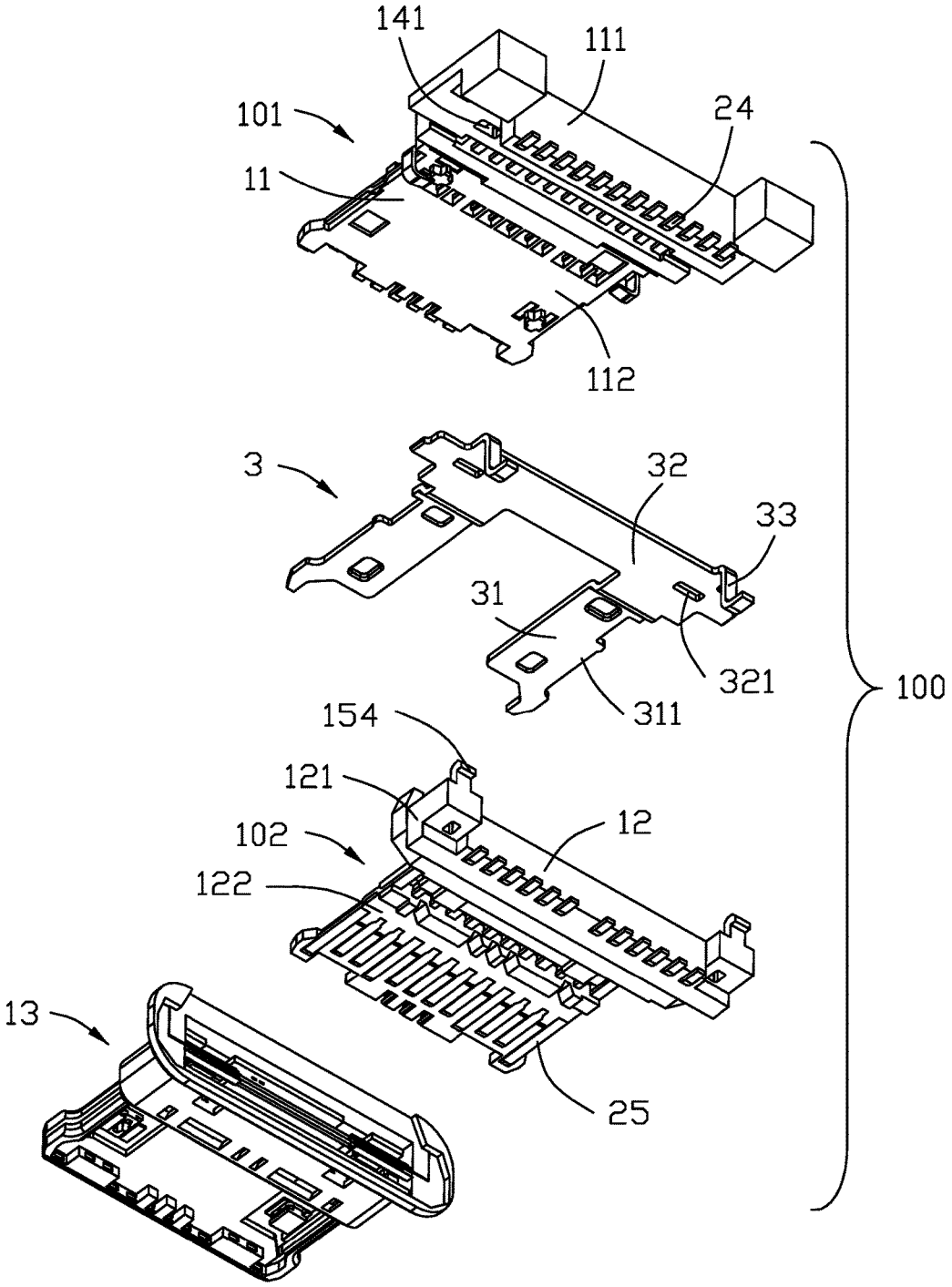
FIG. 4 is another partial exploded view of the electrical connector taken from FIG. 3 in the first embodiment.
Figure 5:
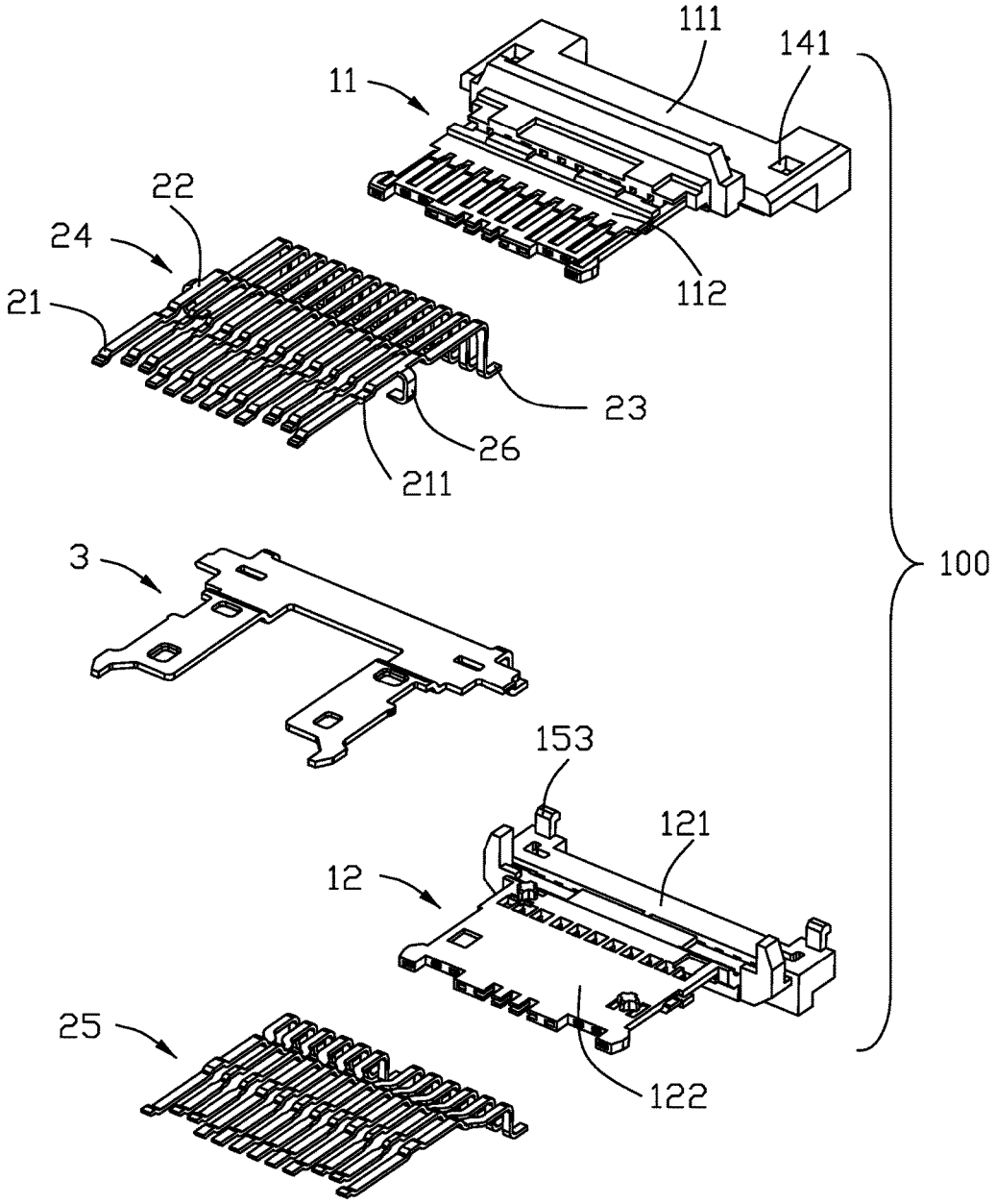
FIG. 5 is a further exploded view of the electrical connector in the first embodiment.
Figure 6:
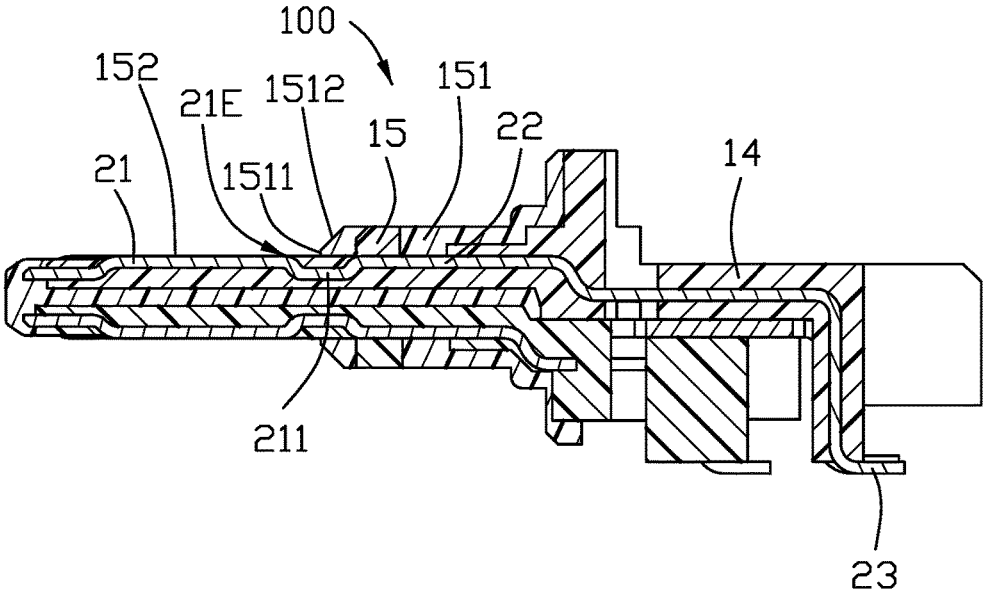
FIG. 6 is cross-sectional view of the electrical connector taken along line 6-6 in FIG. 1 in the first embodiment.

Referring to FIGS. 4 to 6, the electrical connector 100 includes a first contact module 101, a second contact module 102 assembled to the first contact module 101 in a stacked manner along a vertical direction, and a third insulator 13 enclosing the first contact module 101 and the second contact module 102. The first contact module 101 includes a first insulator 11 and a number of first conductive contacts 24. The first insulator 11 includes a first base 111 and a first tongue 112 extending forwardly from the first base 111. The first base 111 includes a pair of buckling holes 141 communicating an upper surface and a bottom surface of the first base 11 and located at lateral sides of an rear end. The second contact module 102 includes a second insulator 12 and a number of second conductive contacts 25 affixed to the second insulator 12. The second insulator 12 includes a second base 121 and a second tongue 122 extending forwardly from the second base 121. The second base 121 includes a pair of buckling legs 154 bending upwardly and located at lateral sides of an rear end thereof. The buckling legs 154 are mated with the buckling holes 141. The insulative housing 1 is essentially composed of the first insulator 11, the second insulator 12 assembled to the first insulator 11, and the third insulator 13 enclosing the first insulator 11 and the second insulator 12. From a rough view, the insulative housing 1 includes a base portion 14 and a tongue portion 15 extending forwardly from the base portion 14 along a front-to-back direction, and including a pair of mating grooves 153 laterally wherein the base portion 14 is essentially composed of the first base 111 and the second base 121 and the tongue portion 15 is essentially composed of the first tongue 112 and the second tongue 122. The tongue portion 15 further includes a stepped portion 151 abutting with the base portion 14, a horizontal portion 152 located in front of the stepped portion 151 and a boundary line 1511 located between the stepped portion 151 and the horizontal portion 152. The stepped portion 151 is thicker than the horizontal portion 152. The stepped portion 151 includes a front or forward confrontation surface 1512 extending in an incline angle. The boundary line 1511 is located at a bottom edge of the front surface 1512. The horizontal portion 152 includes two opposite mating surfaces 1521.

Referring to FIGS. 3 to 6, the conductive contacts 2 include a number of first conductive contacts 24 and a number of second conductive contacts 15. Each conductive contact 2 includes a contacting portion 21 exposed to the mating surface 1521, a soldering portion 23 extending outwardly from the base portion 14, and a connecting portion 22 affixed to the stepped portion 151 and the base portion 14. The connecting portion 22 connects the contacting portion 21 and the soldering portion 23. The contacting portion 21 abutting with the boundary line 1511 is covered by insulative materials. The contacting portion 21 abutting with the boundary line 1511 is embedded in the tongue portion 15 and located in the mating surface 1521. The contacting portion 21 includes a bending portion 211 bending inwardly and being left far away from the mating surfaces 1521. The bending portion 211 is disposed lower than the contacting portion 21 and the connecting portion 22. The bending portion 211, the contacting portion 21 and the connecting portion 22 are substantially arranged in a "concave" shape. The bending portion 211 is located between the horizontal portion 152 and the stepped portion 151. The soldering portion 3 23 of the first conductive contacts 24 and the soldering portions 23 of the second conductive contacts 25 are arranged in two rows. The outermost conductive contact of the first conductive contact 24 extends outwardly to form a pair of fixed portions 26 fixing the second conductive contact 25.

Referring to FIGS. 2 to 6, the shielding plate 3 includes a main portion 32 sandwiched between the first base 111 and the second base 121. The main portion 32 extends laterally from the base portion 14. The main portion 32 includes a pair of locating holes 321 communicating an upper surface and a bottom surface thereof. The locating holes 321 are sandwiched between the buckling holes 141 and the buckling legs 154 and mated with the buckling legs 154. The main portion 32 includes a pair of extending portions 31 extending forwardly, and each extending portion 31 includes a locking lateral side 311 located laterally. The locking lateral side 311 protrudes laterally from the mating groove 153. The shielding plate 3 further includes a pair of soldering pins 33 bending downwardly from the main portion 32.

When assembling the electrical connector 100, the first contact module 101 and the second contact module 102 are assembled together firstly. The first conductive contacts 24 are integrally formed with the first insulator 11 such that the contacting portion 21 is exposed at the first tongue 112, the bending portion 211 is embedded in the horizontal portion 152, and the soldering portion 23 is exposed at an rear end of the first insulator 11. The forming process of the second conductive contacts 25 and the second insulator 12 is similar to that of the first contact module 101. Therefore the forming process of the second contact module 102 will not be described here. In other embodiments, the insulative body can also be molded once. In a second step, the first contact module 101 is integrally formed with the second contact module 102, the shielding plate 3 and the third insulator 13. The buckling legs 154 buckle with the buckling holes 141 through the locating holes 321. The locking lateral sides 311 protrude laterally from the mating grooves 153 and are mated with a corresponding electrical connector.

Since the insulative housing 1 is formed with the stepped portion 151 and the horizontal portion 152 having a thickness smaller than that of the step portion, a boundary line 1511 is formed between the stepped portion 151 and the horizontal portion 152. Because the liquid or other impurities are easy to gather near the boundary line 1511, the present invention buries the tongue portion 15 by bending the contact portion 21 of the conductive contacts 2 inwardly adjacent to the boundary line 1511 so that the conductive contacts 2 are not exposed around the boundary line 1511. At the boundary line 1511, the conductive contacts 2 are protected from contacting with liquids and other impurities to avoid potential corrosion.

In the second embodiment, the reference numerals of the conductive contacts 2' are not the same as those in the first embodiment, and other reference numerals are the same. In order to achieve the above effects, there is another embodiment in FIGS. 7 to 9. In the second embodiment, only the configuration of the conductive contact 2' is different from that of the first embodiment, and the electrical connector 100 further includes additionally a pair of insulative films or covering layers 4 attached to the boundary line 1511 from a vertical direction. The contacting portion 21' is covered by the insulative film 4 near the boundary line 1511 to achieve that the contact portion 21' is covered with the insulative material at the boundary line 1511 when the liquid or other impurity is accumulated at the boundary line 1511. The conductive contacts will not be in contact with liquids or impurities, so as to protect the contact from corrosion. In turn, the conductive contacts 2' are protected from corrosion, thereby protecting the electrical connector.

Understandably, the insulative film 4 may by unitarily formed with the the tongue portion 15 during molding and preferably with the third insulator 13. As shown in FIG. 9, the height A of the stepped portion 151 higher than the horizontal portion 152, is 0.25 mm according to the industry standard, while a thickness B of the additional covering layer 4 is essentially less than one half, preferably one fourth, of the height A, which is smaller enough for not only preventing dust accumulation between the newly formed boundary 41 line between the additional covering layer 4 and the corresponding contacting portion 21', but also avoiding hindering the inserted mating plug connector. Notably, the common feature of both the first embodiment and the second embodiment is to have the rear end 21E or 21E' of the exposed contacting portion 21 or 21' on the corresponding mating surface 1521 terminated in front of the oblique front surface 1512 of the stepped portion 151 with a distance in the front-to-back direction, thus preventing the potential corrosion to the exposed contacting portion 21 or 21' due to dust/humidity accumulation upon the front surface 1512.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector comprising:

an insulative housing comprising a base portion and a tongue portion extending forwardly from the base portion, the tongue portion having a stepped portion abutting with the base portion, a horizontal portion located at a front end of the stepped portion, and a boundary line located between the stepped portion and the horizontal portion, the stepped portion being thicker than the horizontal portion, the horizontal portion having two opposite mating surfaces, and a plurality of conductive contacts affixed to the insulative housing, each conductive contact having a contacting portion exposed to the mating surface, a connecting portion affixed to the stepped portion and the base portion, and a soldering portion extending outwardly from the base portion, wherein the contacting portion abutting with the boundary line is covered by insulative material, wherein the contacting portion abutting with the boundary line is embedded by the tongue portion and not exposed to a surface of the tongue portion, wherein the contacting portion abutting with the boundary line comprises a bending portion bending inwardly and keeping away from the surface of the tongue portion, wherein the bending portion is lower than the contacting portion and the connecting portion, a substantially concave configuration is provided by the bending portion, the contacting portion and the connecting portion, and the bending portion is located between the stepped portion and the horizontal portion.

2. The electrical connector as claimed in claim 1, wherein the contacting portion abutting with the boundary line is covered by an insulative film.

3. The electrical connector as claimed in claim 1, wherein the electrical connector comprises a first contact module comprising a first insulator and a plurality of first conductive contacts affixed to the first insulator, a second contact module comprising a second insulator and a plurality of second conductive contacts affixed to the second insulator, and a shielding plate sandwiched between the first contact module and the second contact module.

4. The electrical connector as claimed in claim 3, wherein the first insulator comprises a first base having a pair of buckling holes communicating an upper surface and a lower surface of the base and located at a rear end thereof and a first tongue extending forwardly from the first base, the second insulator comprises a second base having a pair of buckling legs extending upwardly from a rear end thereof and mated with the buckling holes and a second tongue extending forwardly from the second base, the shielding plate comprises a main portion sandwiched between the first base and the second base and having a pair of locating holes communicating an upper surface and a lower surface of the main portion, the locating holes are sandwiched between the buckling holes and the buckling legs, and the locating holes are mated with the buckling legs.

5. The electrical connector as claimed in claim 1, wherein the shielding plate is embedded in the tongue portion, the shielding plate comprises a main portion extending laterally and affixed to the base portion, the main portion comprises a pair of extending portions extending forwardly, and each extending portion comprises a locking lateral side located laterally.

6. The electrical connector as claimed in claim 3, wherein the connecting portion of the outermost conductive contact of the first conductive contacts extends outwardly to form a fixed portion fixing the outermost conductive contact of the second conductive contacts.

7. The electrical connector as claimed in claim 1, wherein the stepped portion comprises a front surface extending in an inclined angle, and the boundary line forms at a bottom of the front surface.

8. An electrical connector comprising:

an insulative housing including a base portion and a tongue portion unitarily extending forwardly from the base portion in a front-to-back direction, said tongue portion including, along said front-to-back direction, a front horizontal portion defining two opposite mating surfaces in a vertical direction perpendicular to said front-to-back direction, and a rear stepped portion intimately located behind the horizontal portion, thicker than the front horizontal portion in the vertical direction, and having a forward confrontation surface thereon; and two rows of contacts integrally formed with the housing having corresponding contacting portions exposed upon the corresponding mating surfaces, respectively; wherein in each of said contacts, a rear end of the exposed contacting portion is spaced from the confrontation surface with a distance in the front-to-back direction for avoiding potential corrosion due to dust or humidity accumulation upon the confrontation surface, wherein said forward confrontation surface extends in an inclined manner for easy mating with a complementary plug connector, wherein each contact forms a bending portion behind a rear end of the corresponding exposed contacting portion so as to be covered by the housing.

9. The electrical connector as claimed in claim 8, wherein the housing includes a first insulator integrally formed with one row of contacts, and a second insulator integrally formed with the other row of contacts, and a third insulator uniting both the first insulator and the second insulator with a metallic shielding plate therebetween in the vertical direction, and said confrontation surface is formed by the third insulator.

10. An electrical connector comprising: an insulative housing including a base portion and a tongue portion unitarily extending forwardly from the base portion in a front-to-back direction, said tongue portion including, along said front-to-back direction, a front horizontal portion defining two opposite mating surfaces in a vertical direction perpendicular to said front-to-back direction, and a rear stepped portion intimately located behind the horizontal portion, thicker than the front horizontal portion in the vertical direction, and having a forward confrontation surface thereon; and two rows of contacts integrally formed with the housing having corresponding contacting portions exposed upon the corresponding mating surfaces, respectively; wherein in each of said contacts, a rear end of the exposed contacting portion is spaced from the confrontation surface with a distance in the front-to-back direction for avoiding potential corrosion due to dust or humidity accumulation upon the confrontation surface, wherein an additional insulative covering layer is formed upon the horizontal portion and located intimately in front of the confrontation surface to cover the corresponding contacts, wherein a height of the stepped portion compared with the horizontal portion is 0.25 mm while a thickness of the layer is at least less than one half of the height of the stepped portion.

11. The electrical connector as claimed in claim 10, wherein said covering layer is unitarily formed with the housing.

* * * * *